US005929007A

United States Patent [19]

Feng

[11] Patent Number: 5,929,007

[45] Date of Patent: Jul. 27, 1999

[54] ALKALINE AQUEOUS HARD SURFACE CLEANING COMPOSITIONS

[75] Inventor: James Feng, Ft. Lee, N.J.

[73] Assignee: Reckitt & Colman Inc., Wayne, N.J.

[21] Appl. No.: 08/837,920

[22] Filed: Apr. 11, 1997

Related U.S. Application Data

[60] Provisional application No. 60/018,234, May 24, 1996.

[30] Foreign Application Priority Data

Aug. 23, 1996 [GB] United Kingdom ..... 9617648

[51] Int. Cl.[6] ..... C11D 1/75; C11D 3/44

[52] U.S. Cl. ..... 510/197; 510/198; 510/362; 510/365; 510/433; 510/503; 510/506

[58] Field of Search ..... 510/365, 503, 510/427, 433, 506, 423, 237, 197, 198, 362; 134/39, 40, 22.19

[56] References Cited

U.S. PATENT DOCUMENTS

| | | | |
|---|---|---|---|
| 4,264,479 | 4/1981 | Flanagan | 252/524 |
| 4,690,779 | 9/1987 | Baker et al. | 252/546 |
| 5,522,942 | 6/1996 | Graubart et al. | 134/40 |
| 5,523,024 | 6/1996 | Garabedian, Jr. et al. | 252/547 |
| 5,817,615 | 10/1998 | Garabedian et al. | 510/503 |

FOREIGN PATENT DOCUMENTS

| | | | |
|---|---|---|---|
| 0 095 045 A1 | 11/1983 | European Pat. Off. | A62D 3/00 |
| 0 595 590 A2 | 5/1994 | European Pat. Off. | C11D 1/83 |
| 0 621 335 A2 | 10/1994 | European Pat. Off. | C11D 1/835 |
| 0 630 965 A1 | 12/1994 | European Pat. Off. | C11D 3/37 |
| 0 691 397 A2 | 1/1996 | European Pat. Off. | C11D 3/00 |
| WO 93/16162 | 8/1993 | WIPO | C11D 3/43 |
| WO 94/22996 | 10/1994 | WIPO | C11D 1/75 |

*Primary Examiner*—Yogendra Gupta
*Assistant Examiner*—Gregory E. Webb
*Attorney, Agent, or Firm*—Fish & Richardson P.C.

[57] ABSTRACT

Alkaline aqueous hard surface cleaning compositions which exhibit good cleaning efficacy against hardened dried or baked on greasy soil deposits. They are storage stable, and are not undesirably irritating to the skin or mucous tissues of the user. These compositions comprise in percent by weight (based on 100% total weight of a composition):

- 0.01–0.85% wt. nonionic surfactant compound based on an amine oxide;
- 0–1.5% wt. chelating agent;
- 0.01–2.5% wt. caustic;
- 3.0–9.0% wt. glycol ether solvent system comprising one glycol ether or glycol ether acetate solvent having a solubility in water of not more than 20% wt., and a second glycol ether or glycol ether acetate having a solubility of approximately 100% wt., wherein the ratio of the former to the latter is from 0.5:1 to 1.5:1;
- 0–5.0% wt. of a water soluble amine containing organic compound;
- 0–2.5% wt. soil anti-redeposition agent;
- 0–2.5% wt. optional constituents.

The compositions according to the invention contain no anionic or cationic type surfactant constituents, and include no more than 10% wt. of volatile organic constituents (VOCs). Methods for the use of such cleaning compositions, and processes for their production are also disclosed.

20 Claims, No Drawings

ALKALINE AQUEOUS HARD SURFACE CLEANING COMPOSITIONS

This application claims priority from provisional application 60/018,234 filed May 24, 1996 and from Great Britain Application 9617648.2 filed Aug. 23, 1996.

FIELD OF THE INVENTION

The present invention relates to hard surface cleaners which are particularly useful in the cleaning of greasy soil laden surfaces. More particularly the present invention relates to hard surface cleaning compositions which are particularly useful in the cleaning of hardened or baked-on greasy soils on hard surfaces.

BACKGROUND OF THE INVENTION

A wide variety of cleaning compositions which are effective in the cleaning of hard surfaces, such as surfaces normally encountered in kitchens and bathrooms, are known to the art. Many such compositions provide specifically directed cleaning benefits which are targeted at specific types of stains and soils deposited on said hard surfaces. These include, for example, mineral and salt deposits which are known also as hard water stains. Further types of stain which are particularly difficult to remove are aged, dried or baked on stains which are frequently the residues of cooking oils and greases. Such materials are typically not difficult to remove where such deposits are light and/or the material has not yet been permitted sufficient time to dry and harden. However, the converse is also true; after being baked on or dried, such residues of cooking oils and greases are extremely difficult to remove with most cleaning compositions.

A commercially acceptable cleaning composition, in order to be considered particularly useful to a consumer much demonstrate excellent efficacy in the removal of such dried or baked on greasy stains and soils.

A further characteristic which such a commercially acceptable cleaning composition must possess is long term stability. Particularly, a commercially acceptable cleaning composition must exhibit an appreciable shelf stability following its formulation so that it continues to exhibit excellent cleaning efficacy against dried or baked on greasy stains and soils even after several months of shelf life.

A still further characteristic of a commercially acceptable cleaning composition is a sufficiently low level of dermal and/or ocular irritation, such that no unacceptable hazard is associated with the use of such a composition by a consumer.

From the foregoing, then it is apparent that there is a real and continuing need in the art to produce improved cleaning compositions which are especially useful in the removal of dried or baked on greasy stains and soils, and which satisfy further characteristics required for such a product in order to be considered commercially acceptable.

Such a need is satisfied by the present inventive compositions which are aqueous hard surface cleaning composition particularly beneficial in the removal of greasy stains and soils on hard surfaces, especially where such stains and soils are hardened or baked on.

SUMMARY OF THE INVENTION

Accordingly, in one aspect the present invention provides a shelf stable, aqueous hard surface cleaning composition which is particularly effective against aged or baked on greasy stains and soils. The composition comprises in percent by weight (based on 100% total weight of a composition):

- 0.01–0.85% nonionic surfactant compound based on an amine oxide;
- 0–1.5% chelating agent;
- 0.01–2.5% caustic;
- 3.0–9.0% glycol ether solvent system comprising one glycol ether or glycol ether acetate solvent having a solubility in water of not more than 20% wt., and a second glycol ether or glycol ether acetate having a solubility of approximately 100% wt., wherein the ratio of the former to the latter is from 0.5:1 to 1.5:1;
- 0–5.0% of a water soluble amine containing organic compound;
- 0–2.5% soil anti-redeposition agent;
- 0–2.5% optional constituents to 100% water.

The compositions according to the invention are further characterized in that they contain no further anionic or cationic type surfactant constituents. The compositions of the invention also include no more than 10% wt. of volatile organic constituents (VOCs) of which greater amounts are undesirable from an environmental standpoint.

According to a further aspect of the invention there is provided a method for cleaning a hard surface having baked-on greasy or oily stains which comprises the step of: applying an effective amount of the composition noted above for the removal of the said stains.

DETAILED DISCLOSURE

The compositions according to the invention may be further characterized in that they are effective for the removal of common types of stains and soil deposits frequently encountered on hard surfaces in food preparation environments, and are particularly effective in the removal of aged, dried, hardened or baked-on stains based on residues of cooking oils and greases. The compositions of the invention desirably exhibit good shelf stability, particularly as demonstrated by accelerated shelf life testing wherein the compositions are stored in temperature to 120° F. (48.8° C.) for a one week period. The compositions of the invention are also not undesirably irritating to the skin.

The compositions according to the invention include at least one nonionic surfactant compound based on an amine oxide. One general class of useful amine oxides include alkyl di (lower alkyl) amine oxides in which the first alkyl group has about 10–20, and preferably 12–16 carbon atoms, and can be straight or branched chain, saturated or unsaturated. The lower alkyl groups include between 1 and 7 carbon atoms. Examples include lauryl dimethyl amine oxide, myristyl dimethyl amine oxide, and those amine oxides in which the alkyl group is a mixture of different amine oxides, e.g., dimethyl cocoamine oxide, dimethyl (hydrogenated tallow) amine oxide, and myristyl/palmityl dimethyl amine oxide.

A further class of useful amine oxides include alkyl di(hydroxy lower alkyl) amine oxides in which the alkyl group has about 10–20, and preferably 12–16 carbon atoms, and can be straight or branched chain, saturated or unsaturated. Examples are bis(2-hydroxyethyl) cocoamine oxide, bis(2-hydroxyethyl) tallowamine oxide; and bis (2hydroxyethyl) stearylamine oxide.

Further useful amine oxides include those which may be characterized as alkylamidopropyl di(lower alkyl) amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide.

Additional useful amine oxides include alkylmorpholine oxides in which the alkyl group has about 10–20, and preferably 12–16 carbon atoms, and can be straight or branched chain, saturated or unsaturated.

Particularly useful are those amine oxides which are presently commercially available under the trademark AMMONYX (commercially available from the Stepan Co., Northfield, Ill.) i.e., AMMONYX CDO (cocoamido propyl dimethyl amine oxide); AMMONYX CO (cetyl dimethyl amine oxide); AMMONYX DMCD-40 (lauryl dimethyl amine oxide); AMMONYX LO (lauryl dimethyl amine oxide); AMMONYX MCO (myristyl cetyl dimethyl amine oxide); AMMONYX MO (myristyl dimethyl amine oxide.

The amine oxide surfactant compound may be present in an amount of from 0.01 to 0.85 % wt. based on the total weight of the composition, but more desirably from 0.1 to 0.75%.

The compositions of the invention include a chelating agent which is effective in complexing with the metal ions commonly found in fats, oils and other organic soils, especially in greasy stains and soils. Examples of chelating agents which can be employed include gluconic acid, tartartic acid, citric acid, oxalic acid, lactic acid, ethylenediaminetetraacetic acid, N-hydroxyethylethylenediamine triacetic acid, nitrilotriacetic acid, diethylene triamine pentaacetic acid, and their water soluble salts, especially the alkali metal salts and particularly the sodium salts. Particularly advantageously used are di-, tri- and tetrasodium salts of ethylenediaminetetraacetic acid, especially tetrasodium salts thereof. However, it is to be understood that where such di-, tri- and tetra-sodium salts of ethylenediaminetetraacetic acid pose a concern from an environmental viewpoint, they may be eliminated from the formulations, and/or one or more further chelating agents which are more acceptable may be used in the formulations; such acceptable chelating agents include citrate, gluconate or glucoheptonate salts, particularly sodium citrate, sodium gluconate and sodium glucoheptonate.

The chelating agents may be desirably included present in any effective amounts, with amounts of from 0–1.5% wt. being a particularly useful weight range. In certain areas, the use of chelating agents may be undesired, in which case it may be omitted from the inventive compositions. According to certain preferred embodiments where chelating agents are present, they are used in an amount to comprise from 0.01 to 1.0% wt. based on the total weight of the cleaning composition of which they form a part.

The compositions of the invention also include a caustic which is desirably present in sufficient amounts to ensure that the overall pH of the compositions are at least about 11.5 or greater, especially at least about 13 or greater, and further, to provide an efficacious cleaning benefit against hardened, dried or baked on greasy soil deposits on hard surfaces.

Useful as the caustic constituent according to the invention are any one or more calcined or anhydrous alkali metal carbonates, preferably a sodium or potassium carbonate, especially sodium carbonate. Also useful are corresponding phosphates especially trisodium phosphates, sodium tripolyphosphate and disodium hydrogen phosphate. Bicarbonates, silicates and borates may also be used, preferably as sodium salts, e.g., borax, sodium bicarbonate and sodium silicates such as $Na_wO:SiO_2$. Also useful and preferred for use as the caustic constituent are one or more calcined or anhydrous alkali metal hydroxides, particularly sodium hydroxide. The caustic constituent may be supplied in any of a variety of forms including solid forms, as well as dispersions such as aqueous dispersions, mixtures or solutions of one or more caustic constituents in a volume of water.

The compositions of the invention desirably include one or more water soluble, amine-containing organic compounds which are effective as a protein denaturant. Particularly advantageously employed as this component are alkanolamides which may include single or multiple amine groups, of which mono- and di-(lower alkyl)amines such as monoethanolamine are most preferred.

The amine-containing organic compounds are desirably included in the inventive compositions so to comprise from 0.5 to 5.0% wt. based on the total weight of the compositions, but even more desirably comprise from 1.5–4.0% wt. based on the total weight of the inventive compositions.

The hard surface cleaning compositions of the invention further include a glycol ether solvent system comprising one glycol ether solvent having a solubility in water of not more than 20% wt., and a second glycol ether having a solubility in water of approximately 100% wt., wherein the ratio of the former to the latter is from 0.5:1 to 1.2:1.

Useful solvents which may be incorporated in the inventive compositions include glycol ethers especially those having the general structure Ra—O—Rb—OH, as well as glycol ether acetates having the general structure Ra—O—Rb—$COOCH_3$ wherein Ra is an alkoxy of 1 to 20 carbon atoms, or aryloxy of at least 6 carbon atoms, and Rb is an ether condensate of propylene glycol and/or ethylene glycol having from one to ten glycol monomer units. Preferred are glycol ethers and glycol acetates having one to five glycol monomer units. Particularly useful as the glycol ether or glycol ether acetate solvent having a solubility in water of not more than 20% wt. are, by way of example (and not by limitation): propylene glycol methyl ether acetate, dipropylene glycol methyl ether acetate, propylene glycol n-butyl ether acetate, dipropylene glycol n-butyl ether acetate, tripropylene glycol n-butyl ether acetate, propylene glycol phenyl ether acetate, and dipropylene glycol n-propyl ether acetate, of which propylene glycol n-butyl ether acetate is especially advantageously employed in the inventive compositions.

As noted, these solvents exhibit a solubility in water of not more than 20% wt., which is approximately equal to the millilitres of a the specific solvent per 100 ml of water and, for the purposes of this specification, are considered to be equivalent units of measure. More desirably however, these solvents having limited solubility in water are those which exhibit no more than 9% wt. in water, (or 9ml solvent/100 ml water) and even more desirably include those which exhibit from 1 to 7% wt. in water (or 1 to 7 ml solvent/100 ml water).

Particularly advantageously used as the glycol ether solvent are, by way of example (and not by limitation): propylene glycol methyl ether, dipropylene glycol methyl ether, tripropylene glycol methyl ether, propylene glycol n-propyl ether, ethylene glycol n-butyl ether, diethylene glycol n-butyl ether, triethylene glycol butyl ether, diethylene glycol methyl ether, triethylene glycol methyl ether, ethylene glycol phenyl ether, as well as aromatic based glycol ethers.

As noted, these solvents exhibit a solubility in water of approximately 100% wt. in water and more, which is approximately equal to the millilitres of the specific solvent per 100 ml of water and for the purposes of this specification are considered to be equivalent units of measure. Desirably however, these solvents having high solubility in water are those which exhibit about 100% wt. in water, (or 100ml solvent/100 ml water) and even more desirably include those which are considered infinitely soluble in water.

Such solubility criteria which are discussed herein may be ascertained by routine empirical procedures; alternatively, data regarding the solubility characteristics of such glycol ethers and glycol ether acetates may be found from readily available published data. Examples of such empirical procedures as well as published solubility data may be found, or example, in Handbook of Solubility Parameters and Other Properties', A. F. M. Barton (CRC Press, Boca Raton, Fla.) as well as from technical reference sheets and publications available from suppliers of such materials.

These solvents are presently commercially available in the DOWANOL® glycol ether and glycol ether acetate series available from The Dow Chemical Company, (Midland Mich.).

The present inventor has discovered that the use of a single glycol ether or glycol ether acetate as an organic solvent may provide a formulation exhibiting good cleaning characteristics, but such formulations have also been found by the inventor to be phase unstable with degradation of such a formulation being observed when subjected to accelerated aging conditions, namely being heated to 120° F. (49° C.) for a period of time. Such a formulation is not particularly shelf stable, nor is necessarily suitable for commercial use. Surprisingly, the inventor has found that the use of two solvents, each based on a glycol ether or glycol ether acetate but of markedly different water solubility, provides good cleaning characteristics, and at the same time maintains good formulation stability when subjected to such accelerated aging conditions.

The inventor has also surprisingly discovered that the addition of a further anionic or cationic surfactant to the formulation causes an appreciable decrease in the cleaning properties of such a composition. Such would not be expected in the art, as the inclusion of such surfactants would normally be expected to facilitate the penetration and removal of oily stains and oily soil deposits.

Water forms a further constituent according to the invention, and is added to the constituents noted above in an amount to provide 100% by weight of the composition. The water may be provided from a variety of sources, including tap water, but is preferably distilled and is most preferably deionized or 'soft' water. If the water is tap water, it is preferably substantially free of any undesirable impurities such as organics or inorganics, especially minerals salts which are present in hard water and may interfere with the operation of one or more of the essential constituents, as well as other optional constituents of the hard surface cleaning compositions according to the invention.

The compositions of the invention optionally, but desirably, include a soil anti-redeposition agent which may include any of those which are currently known and used in the art relating to hard surface cleaners. Such include by way of example, compositions based on polyacrylic acids and salts thereof, fatty amides complexes, silicone copolymers, polyvinylpyrrolidone, synthetic hectorite, colloidal silica, styrene maleic anhydride copolymers, as well as esters and partial esters thereof, polycarboxylate copolymers, as well as others not specifically elucidated here. When included in the inventive compositions, particularly useful agelits are those based on polyacrylic acid as well as salts thereof. When included in the compositions, such soil anti-redeposition agents need be present in only minor amounts, with amount of up to 2.5% wt. generally found to be effective, but even more desirably lesser amounts are used such as up to about 0.7% wt. being typically sufficiently effective.

The compositions of the invention may also include one or more further optional constituents.

One advantageously utilized optional constituent is a water soluble or dispersible preservative, since a significant portion of the formulation comprises water. Such water soluble preservatives include compositions such as parabens including methyl parabens and ethyl parabens, glutaraldehyde, formaldehyde, 5-chloro-2-methyl-4-isothiazolin3-one, 2-methyl-4-isothiazoline-3-one, and mixtures thereof. One exemplary composition is a combination of 5-chloro-2-methyl-4-isothiazolin-3-one and 2-methyl-4isothiazolin-3-one where the amount of either component may be present in the mixture anywhere from 0.01 to 99.99 weight percent, based on the total amount of the preservative. Also useful is a mixture of 5-chloro-2methyl-4-isothiazolin-3-one and 2-methyl-4-isothiazolin3-one marketed under the trademark KATHON CG/ICP as a preservative composition commercially available from Rohm and Haas (Philadelphia, Pa.). Further useful commercially available preservative compositions include for example: PROXEL GXL; GLYDANT®, a water soluble preservative based on DMDM hydantoin; GLYDANT Plus, a water soluble preservative based on DMDM hydantoin and iodopropyl butyl carbamate; and TEXTAMER 38 AD.

The hard surface cleaning compositions of the invention may also include one or more optional constituents including, but not limited to: buffers, pH buffering agents, fragrances, fragrance carriers and adjuvants which increase their miscibility in the aqueous compositions, colorants, hydrotropes, antifoaming agents, anti-oxidants, anti-corrosion agents particularly when formulated for use in a pressurized aerosol container, as well as others known to the art but not specifically mentioned herein. Such volatile materials, fragrances, fragrance carriers and adjuvants are not considered as VOCs in the compositions of the invention. One particularly desirable additive is a thickening agent, or other viscosity modifying agent such as those based on alginates and guns, e.g., xantham gum.

It is to be noted that such optional constituents may be included in minor amounts, generally in total comprising no more than about 2.5% wt., of the total composition of which they form a part. It is to be further noted that particular care must be exercised in their inclusion and selection especially with respect to the total amount of VOCs which may be present in a composition, and also with regard to any detrimental effects to the overall cleaning and stability features of the compositions.

In one aspect according to the invention, there is provided a shelf stable, aqueous hard surface cleaning composition having a pH of at least 12.5 which is particularly effective against aged or baked on greasy stains and soils and comprises in percent by weight (based on 100% total weight of a composition):

- 0.5–0.8% wt. amine oxide based nonionic surfactant compound;
- 0.2–0.6% wt. salt of ethylenediamine tetraacetic acid;
- 0.1–0.5% wt. alkali metal hydroxide;
- 1.5–4.0% wt. alkanolamine;
- 5.0–7.0% wt. glycol ether solvent system comprising one glycol ether solvent having a solubility in water of not more than 20% wt., and a second glycol ether having a solubility of about 100% wt. in water, wherein the ratio of the former to the latter is from 0.5:1 to 1.5:1;

0–5.0% wt. water soluble amine containing organic compound;

0–0.7% wt. soil anti-redeposition agent;

0–1.0% wt. optional constituents to 100% wt. water.

Desirably, the amine oxide nonionic surfactant compound is lauryl dimethyl amine oxide, the first glycol ether solvent is propylene glycol n-butyl ether, and the second glycol ether solvent is dipropylene glycol methyl ether.

In accordance with a further aspect of the invention, there is provided a shelf stable, aqueous hard surface cleaning composition having a pH of at least 12.5 which is particularly effective against aged or baked on greasy stains and soils and comprises in percent by weight (based on 100% total weight of a composition):

0.5–0.8% wt. amine oxide based nonionic surfactant compound;

0.1–1.5% wt. of a chelating agent, preferably selected from citrates, gluconates and glucoheptonates, particularly sodium salts thereof;

0.1–0.5% wt. alkali metal hydroxide;

1.5–4.0% wt. alkanolamine;

5.0–7.0% wt. glycol ether solvent system comprising one glycol ether solvent having a solubility in water of not more than 20% wt., and a second glycol ether having a solubility of about 100% wt. in water, wherein the ratio of the former to the latter is from 0.5:1 to 1.5:1;

0–5.0% wt. water soluble amine containing organic compound;

0–0.7% wt. soil anti-redeposition agent;

0–1.0% wt. optional constituents to 100% wt. water.

Desirably, the amine oxide nonionic surfactant compound is lauryl dimethyl amine oxide, the first glycol ether solvent is propylene glycol n-butyl ether, and the second glycol ether solvent is dipropylene glycol methyl ether. An advantage of this second aspect of the invention is the elimination of ethylenediaminetetraacetic acid from the formulation which may be desirable from an environmental perspective.

The benefits of the inventive compositions described in this specification include particularly: good removal of greasy soils and deposits on hard surfaces, particularly those which have been aged or "baked on", relatively low dermal irritation notwithstanding the alkaline nature of the compositions, exhibit shelf stability at room temperature (approx. 20° C.) and preferred compositions exhibit good high temperature stability when heated to 120° F. (49° C.) for a period of 1 week, as well as ease in handling of the composition due to its readily pourable or pumpable characteristic. Further, when one or more of the optional constituents is added, i.e., fragrance, foaming agents, coloring agents, the aesthetic and consumer appeal of the product is improved.

Notwithstanding that the pH of preferred embodiments of compositions according to the present invention is in excess of 11, and desirably is about 13 and higher, it has been surprisingly been found that these formulations do not appear to be particularly irritating to the skin or mucous tissues of a consumer. Such is a surprising effect, as the alkaline character of the compositions and their correspondingly relatively high pH would be expected to be an irritant.

A hard surface cleaning composition according to the invention may be readily produced by adding one or more of the constituents to water, generally with the nonionic surfactant being added first, then adding the other components under stirring conditions at room temperature. Stirring continues until a homogenous mixture is produced, which is in a ready to use form.

Such a hard surface cleaning composition according to the invention is desirably provided as a ready to use product which may be directly applied to a hard surface. By way of example, hard surfaces suitable for cleaning with the composition include surfaces composed of refractory materials such as: glazed and unglazed tile, brick, porcelain, ceramics as well as stone including marble, granite, and other stones surfaces; glass; metals, especially stainless steel surfaces; plastics, e.g. polyester, vinyl; Fiberglass®, Formica®, Corian® and other hard surfaces known to the industry. Hard surfaces which are to be particularly denoted are kitchen fixtures and other surfaces associated with areas and equipment used in the preparation of foods such as stove and oven surfaces, other appliance surfaces, cabinets and countertop surfaces as well as walls and floor surfaces.

The hard surface-cleaner composition provided according to the invention can be desirably provided as a ready to use product in a manually operated spray dispensing container. Such a typical container is generally made of synthetic polymer plastic material such as polyethylene, polypropylene, polyvinyl chloride or the like and includes spray nozzle, a dip tube and associated pump dispensing parts and is thus ideally suited for use in a consumer spray-and-wipe application. In such an application, the consumer generally applies an effective amount of the cleaning composition using the pump and within a few moments thereafter, wipes off the treated area with a rag, towel, or sponge, usually a disposable paper towel or sponge. In certain applications, however, especially where undesirable stain deposits are heavy, the cleaning composition according to the invention may be left on the stained area until it has effectively loosened the stain deposits after which it may then be wiped off, rinsed off, or otherwise removed. For particularly heavy deposits of such undesired stains, multiple applications may also be used.

In a yet a further embodiment, the product according to the invention may be formulated so that it may be useful as an aerosol type product wherein it is discharged from a pressurized aerosol container. Known art propellants such as liquid propellants based on chlorofluorocarbons or propellants of the non-liquid form, i.e., pressurized gases, including carbon dioxide, air, nitrogen, as well as others, may be used, even though it is realized that chlorofluorocarbons are not generally used at this time due to environmental considerations. In such an application, the cleaning composition is dispensed by activating the release nozzle of said aerosol type container onto the stain and/or stain area and, in accordance with the manner as above-described a stain is treated and removed.

Whereas the present invention is intended to be used in the types of liquid forms described, nothing in this specification shall be understood as to limit the use of the composition according to the invention with a further amount of water to form a cleaning solution therefrom. In such a proposed diluted cleaning solution, the greater the proportion of water added to form said cleaning dilution, the greater will be the reduction of the rate and/or efficacy of the thus formed cleaning solution. Accordingly, longer residence times upon the stain to effect their loosening and/or the usage of greater amounts may be necessitated. Conversely, nothing in the specification shall be also understood to limit the forming of a super-concentrated cleaning composition based upon the composition described above.

Such a super-concentrated ingredient composition is essentially the same as the cleaning compositions described above except in that it would include a lesser amount of water.

The hard surface cleaning compositions according to the invention are exemplified by the following examplary formulations.

EXAMPLES

Preparation of Example Formulations

Exemplary formulations illustrating certain preferred embodiments of the inventive compositions and described in more detail in Table 1 below were formulated in accordance with the following protocol.

Into a suitably sized vessel, a measured amount of water was provided after which the constituents were added in the following sequence: thickening agent, surfactants, solvents, acid and, lastly, the coloring and fragrance constituents. All of the constituents were supplied at room temperature, and mixing of the constituents was achieved by the use of a mechanical stirrer with a small diameter propeller at the end of its rotating shaft. Mixing, which generally lasted from 5 minutes to 120 minutes was maintained until the particular exemplary formulation appeared to be homogeneous. The exemplary compositions were readily pourable, and retained well mixed characteristics (i.e., stable mixtures) upon standing for extend periods, even in excess of 120 days. It is to be noted that the constituents may be added in any order, but it is preferred that water be the initial constituent provided to a mixing vessel or apparatus, as it is the major constituent and addition of the further constituents thereto is convenient.

The exact compositions of the example formulations are listed on Table 1, below, with the figures denoting weight percentages:

TABLE 1

| | Ex. 1 | Ex. 2 | Ex. 3 | Ex. 4 |
|---|---|---|---|---|
| amine oxide (30% actives) | 2.0 | 2.0 | 2.0 | 2.0 |
| EDTA salt (39% actives) | 0.5 | 0.5 | 0.5 | 0.5 |
| NaOH (50% actives) | 0.8 | 0.8 | 0.8 | 0.8 |
| monoethanolamine | 3.0 | 3.0 | 3.0 | 3.0 |
| glycol ether, low water soluble | 3.0 | 2.8 | 2.8 | 3.0 |
| glycol ether, high water soluble | 3.7 | 3.7 | 3.7 | 3.7 |
| soil anti-redeposition agent | — | 0.5 | 0.5 | 0.5 |
| fragrance | — | 0.1 | 0.1 | — |
| water | to 100 | to 100 | to 100 | to 100 |

The identity of the individual constituents is more fully described on Table 2, below.

TABLE 2

| constituent: | description: |
|---|---|
| amine oxide (30% actives) | lauryl dimethyl amine oxide (30% wt. actives); nonionic surfactant, AMMONYX ® LO (Stepan Co., Northfield IL) |
| EDTA salt | VERSENE ® 100 (39% wt. actives); tetrasodium salt of ethylenediaminetetraacetic acid |
| NaOH (50%) | caustic, (50% wt. actives) sodium hydroxide solution |
| monoethanolamine | 2-aminoethanol (approx. 100% wt. actives) |
| glycol ether, low water soluble | propylene glycol n-butyl ether (approx. 100% wt. active) DOWANOL ® PnB (Dow Chemical Co., Midland MI) |

TABLE 2-continued

| constituent: | description: |
|---|---|
| glycol ether, high water soluble | dipropylene glycol methyl ether (approx. 100% wt. active) DOWANOL ® DPM (Dow Chemical Co., Midland MI) |
| soil anti-redeposition agent | proprietary composition, polyacrylic based; ACUSOL ® 445N (Rohm and Haas Co., Philadelphia PA) |
| fragrance | commercially available proprietary composition |

The compositions of Ex. 2 and Ex. 3 differed only in the use of different fragrance compositions.

For comparative evaluation against the formulations according to Examples 1 through 4 of Table 1, samples of a commercially available hard surface cleaning product advertised as particularly formulated for use on greasy stains was used. Such product was "FORMULA 409 All Purpose Cleaner" which was used as-is from its container, and is identified hereafter as "Comp.".

Cleaning Evaluation

Compositions according to the invention as embodied in the formulations of Table 1 described above, were evaluated against the comparative composition in order to determine their relative cleaning efficacies.

Baked on Soil Test

A test soil was prepared based on the following constituents: peanut oil 26.2% by weight; corn oil 14.5% by weight; cherry pie mix 14.5by weight; 75% lean ground beef 14.5% by weight; ground pork 14.5% by weight; sodium glutamate 0.6% by weight; sodium chloride 0.6% by weight; and water 14.6% by weight. This test oil was prepared in 1,000 gram batches, after which was provided to a ceramic baking dish and heated in an oven for two hours at 400° F. (204.5° C.). Afterwards, the oil portion, which is the test soil, was separated by decanting through several layers of fine cheesecloth from the remaining solids. The remaining filtrate, i.e., the test soil, was sufficiently filtered so as to be substantially clear and void of particle matter. The standard test soil was either used immediately or could be used subsequent to refrigeration if heated to approximately 100° F. (38° C.) and shaken to ensure homogenization thereof The porcelain enamel test plates cut from an oven liner and having a light grayish color, were individually weighed. To each was applied 0.37 grams±0.05 grams of the test soil by brushing uniformly (which corresponds to 0.25 grams on a 4.5 inch by 4.5 inch (11.4 cm×11.4 cm square plate). Subsequently to each of the plates thus treated were reweighed to ensure the proper amount of soil deposited on each plate, after which these soiled plates were placed in aluminum baking trays. The tops of the trays were covered with aluminum foil, however, such covers did not contact the soil applied to each of the plates. These baking trays were placed in a large convection oven in a staggered position, and never at the bottom of the oven. The plates were baked for 45 minutes at 375° C. (190.5° C.) (which permitted the test soil to be "baked on"). Afterwards, the trays containing each of the treated plates were removed and allowed to cool. The test soil thus "baked on" onto each of the enamel plates was a light to medium brownish color and, when cooled, formed a slightly sticky film when touched.

The cleaning efficacy of the formulations denoted were evaluated in accordance with the following general protocol, using the test plates prepared as described above. First each of the plates were divided into two equal halves, using ½ inch (1.2 cm) wide masking tape thus separating a first side from a second side. The tape was positioned approximately centrally on each of the test plates, thereby approximately bisecting its surface prepared with the test stain.

Evaluations of the cleaning efficacy of the formulations according to the invention, as well as that of the comparative formulation, were formed in accordance with the following general manner.

A 400 gram amount of a formulation according to Example 2 described in detail in Table 1 above were poured into a first plastic vessel. Similarly, a 400 gram sample of the comparative formulation was poured into a second vessel.

For each of the plates within the test, one of the bisected sides of the surface was inserted in the first container for a 10 minute period during which the formulation according to the invention was permitted to act upon the test soil. No agitation, physical scrubbing or wiping was performed during this soaking period. After this 10 minute soaking period, the plate was removed and rinsed under a flush of cold tap water. Afterwards, with a water dampened cellulose sponge, the sponge was lightly used to move any loosened soil from the surface of the plate.

The same protocol regarding the 10 minute soak time, the cold water wash and the light sponging was followed for the other side of the test plate, however, the comparative formulation was tested.

In the same manner, individual test plates were cleaned using the comparative composition and a formulation of Table 1.

Subsequently, the individual plates were then bordered on each of its remaining exterior edges with a ½ inch (1.2 cm) wide masking tape in preparation for a visual evaluation by a group of 20 panelists. The plates were laid out in a square matrix pattern and each of 20 panelists was asked to rate the plates by visual inspection. The panelists were asked to rate each plate individually, indicating their perception of soil removed, 0% being no soil removed to 100% indicating complete: soil removal for each of the two halves of each test plate. These results indicate the relative efficacy of these formulations according to the invention, versus the comparative compositions.

Subsequently, based on these visual ranking results, the average of the differences between the rating reported by the panelists for each of the two cleaned sides of each test tile, which is reported in Table 3 below.

TABLE 3

| | |
|---|---|
| Tile 1ab | 76 |
| Tile 2ab | 71.45 |
| Tile 3ab | 85.75 |
| Tile 4ab | 84.6 |
| Tile 5ab | 77 |
| Tile 6ab | 68.35 |
| Tile 7ab | 61.8 |
| Tile 8ab | 55.2 |
| Tile 9ab | 52.4 |
| Tile 10ab | 65.65 |

These results were then evaluated in accordance with the standard statistical procedure, One Sample T-test at a 95% confidence interval which result indicated that the formulation according the invention significantly outperformed the comparative composition, "FORMULA 409 All Purpose Cleaner" (The Clorox Company, Oakland, Calif.).

Wallboard Cleaning Test (ASTM D-4488)

Test soiled surfaces of painted Masonite wallboard were prepared generally in accordance with the test protocols outlined in ASTM D-4488(A2). In accordance with this test, a painted Masonite wallboard sample was soiled with a mixture of melted oily solids containing a small amount of carbon black, which is allowed to set overnight. Test cleaning compositions and/or comparative cleaning compositions were applied to a sponge which scrubs half of the wallboard sample utilizing a Gardner Washability Apparatus, a standard pressure and standard sponge stroke settings, in order to determine or quantify the cleaning efficiency of the formulations treated with an equal amount of each formulation and stroked an equal number of times. Equal amounts of the formulations were used "as is" and were not further diluted.

In determining the cleaning efficiency of each of the formulations, reflectance values were determined for each of the wallboard samples using a Minolta Chromameter which tested each wallboard at least three times. The mean reflectance values are reported below in Table 4 as well as in Table 5. In Table 4, the formulation according to Example 1 described on Table 1 was evaluated against the comparative composition. In Table 5, the formulation according to Example 4 described on Table 1 was evaluated against the comparative composition. Such reflectance values were then employed to calculate % Cleaning Efficiency according to the following formula:

$$\%\ \text{Cleaning Efficiency} = \frac{Rc - Rs}{Ro - Rs} \times 100\%$$

wherein:

Rc=% reflectance average after scrubbing solid tile;

Rs=% reflectance average before cleaning soiled tile;

Ro=% reflectance average original tile before soiling.

TABLE 4

| | Ro | Rs | Rc | % Cleaning Efficiency |
|---|---|---|---|---|
| | | Comparative Composition | | |
| Tile 1a | 91.36 | 29.83 | 74.2 | 72.11117 |
| Tile 2a | 91.36 | 29.83 | 73.77 | 71.41232 |
| Tile 3a | 91.36 | 29.83 | 75.17 | 73.68763 |
| Tile 4a | 91.36 | 29.83 | 73.65 | 71.21729 |
| Tile 5a | 91.36 | 29.83 | 74.48 | 72.56623 |
| Tile 6a | 91.36 | 29.83 | 71.79 | 68.19438 |
| Tile 7a | 91.36 | 29.83 | 71.41 | 67.57679 |
| Tile 8a | 91.36 | 29.83 | 71.77 | 68.16187 |
| Tile 9a | 91.36 | 29.83 | 75.81 | 74.72778 |
| Tile 10a | 91.36 | 29.83 | 74.32 | 72.30619 |
| Tile 11a | 91.36 | 29.83 | 73.42 | 70.84349 |
| Tile 12a | 91.36 | 29.83 | 73.46 | 70.9085 |
| Tile 13a | 91.36 | 29.83 | 77.17 | 76.93808 |
| Tile 14a | 91.36 | 29.83 | 75.6 | 74.38648 |
| Tile 15a | 91.36 | 29 83 | 73.55 | 71.05477 |
| Tile 16a | 91.36 | 29.83 | 77.03 | 76.71055 |
| Tile 17a | 91.36 | 29.83 | 76.63 | 76.06046 |
| Tile 18a | 91.36 | 29.83 | 77.7 | 77.79945 |
| Tile 19a | 91.36 | 29.83 | 74.81 | 73.10255 |
| Tile 20a | 91.36 | 29.83 | 76.95 | 76.58053 |
| | | Example 1 | | |
| Tile 1b | 91.36 | 29.83 | 73.42 | 70.84349 |
| Tile 2b | 91.36 | 29.83 | 74.45 | 72.51747 |
| Tile 3b | 91.36 | 29.83 | 75.24 | 73.8014 |
| Tile 4b | 91.36 | 29.83 | 74.24 | 72.17617 |
| Tile 5b | 91.36 | 29.83 | 75.38 | 74.02893 |
| Tile 6b | 91.36 | 29.83 | 75.05 | 73.49261 |
| Tile 7b | 91.36 | 29.83 | 73.09 | 70.30717 |
| Tile 8b | 91.36 | 29.83 | 74.01 | 71.80237 |
| Tile 9b | 91.36 | 29.83 | 76.62 | 76.04421 |

TABLE 4-continued

| | Ro | Rs | Rc | % Cleaning Efficiency |
|---|---|---|---|---|
| Tile 10b | 91.36 | 29.83 | 74.35 | 72.35495 |
| Tile 11b | 91.36 | 29.83 | 73.38 | 70.7848 |
| Tile 12b | 31.36 | 29.83 | 74.74 | 72.98879 |
| Tile 13b | 91.36 | 29.83 | 78.4 | 78.9371 |
| Tile 14b | 31.36 | 29.83 | 76.74 | 76.23923 |
| Tile 15b | 91.36 | 29.83 | 76.59 | 75.99545 |
| Tile 16b | 91.36 | 29.83 | 78.11 | 78.46579 |
| Tile 17b | 91.36 | 29.83 | 78.85 | 79.66845 |
| Tile 18b | 91.36 | 29.83 | 77.5 | 77.4744 |
| Tile 19b | 91.36 | 29.83 | 74.09 | 71.93239 |
| Tile 20b | 91.36 | 29.83 | 77.07 | 76.77556 |

These results were then statistically evaluated according to the Two Sample T-Test at a 95% confidence interval, which confirmed that at this high confidence level than the formulation of Ex. 1 according to the invention provided excellent cleaning results.

TABLE 5

| | Ro | Rs | Rc | % Cleaning Efficiency |
|---|---|---|---|---|
| | | Comparative Composition | | |
| Tile 1a | 93.64 | 28.42 | 78.46 | 76.72493 |
| Tile 2a | 93.64 | 28.42 | 81.6 | 81.53941 |
| Tile 3a | 93.64 | 28.42 | 79.54 | 78.38086 |
| Tile 4a | 93.64 | 28.42 | 77.44 | 75.16099 |
| Tile 5a | 93.64 | 28.42 | 80.34 | 79.60748 |
| Tile 6a | 93.64 | 28.42 | 79.48 | 78.28887 |
| Tile 7a | 93.64 | 28.42 | 80.67 | 80.11346 |
| Tile 8a | 93.64 | 28.42 | 80.28 | 79.51549 |
| Tile 9a | 93.64 | 28.42 | 80.1 | 79.2395 |
| Tile 10a | 93.64 | 28.42 | 79.81 | 78.79485 |
| Tile 11a | 93.64 | 28.42 | 82.66 | 83.16467 |
| Tile 12a | 93.64 | 28.42 | 80.98 | 80.58878 |
| Tile 13a | 93.64 | 28.42 | 77.18 | 74.76234 |
| Tile 14a | 93.64 | 28.42 | 78.72 | 77.12358 |
| Tile 15a | 93.64 | 28.42 | 80.52 | 79.88347 |
| Tile 16a | 93.64 | 28.42 | 80.7 | 80.15946 |
| Tile 17a | 93.64 | 28.42 | 79.92 | 78.96351 |
| Tile 18a | 93.64 | 28.42 | 78.91 | 77.4149 |
| Tile 19a | 93.64 | 28.42 | 79.94 | 78.99417 |
| Tile 20a | 93.64 | 28.42 | 81.69 | 81.6774 |
| Tile 21a | 93.64 | 28.42 | 80.89 | 80.45078 |
| Tile 22a | 93.64 | 28.42 | 80.85 | 80.38945 |
| Tile 23a | 93.64 | 28.42 | 80.09 | 79.22416 |
| Tile 24a | 93.64 | 28.42 | 83.02 | 83.71665 |
| Tile 25a | 93.64 | 28.42 | 79.78 | 78.74885 |
| Tile 26a | 93.64 | 28.42 | 80.11 | 79.25483 |
| Tile 27a | 93.64 | 28.42 | 82.9 | 83.53266 |
| Tile 28a | 93.64 | 28.42 | 83.11 | 83.85465 |
| Tile 29a | 93.64 | 28.42 | 82.4 | 82.76602 |
| | | Example 4 | | |
| Title 1b | 93.64 | 28.42 | 80.04 | 79.1475 |
| Title 2b | 93.64 | 28.42 | 81.25 | 81.00276 |
| Title 3b | 93.64 | 28.42 | 81.39 | 81.21742 |
| Title 4b | 93.64 | 28.42 | 82.61 | 83.08801 |
| Title 5b | 93.64 | 28.42 | 82.24 | 82.5207 |
| Title 6b | 93.64 | 28.42 | 82.25 | 82.53603 |
| Title 7b | 93.64 | 28.42 | 82.47 | 82.87335 |
| Title 8b | 93.64 | 28.42 | 83.76 | 84.85127 |
| Title 9b | 93.64 | 28.42 | 81.96 | 82.09138 |
| Title 10b | 93.64 | 28.42 | 83.42 | 84.32996 |
| Title 11b | 93.64 | 28.42 | 82.27 | 82.5667 |
| Title 12b | 93.64 | 28.42 | 83.69 | 84.74394 |
| Title 13b | 93.64 | 28.42 | 81.91 | 82.01472 |
| Title 14b | 93.64 | 28.42 | 81.72 | 81.7234 |
| Title 15b | 93.64 | 28.42 | 84.12 | 85.40325 |
| Title 16b | 93.64 | 28.42 | 83.06 | 83.77798 |
| Title 17b | 93.64 | 28.42 | 80.03 | 79.13217 |

TABLE 5-continued

| | Ro | Rs | Rc | % Cleaning Efficiency |
|---|---|---|---|---|
| Title 18b | 93.64 | 28.42 | 81.99 | 82.13738 |
| Title 19b | 93.64 | 28.42 | 81.42 | 81.26342 |
| Title 20b | 93.64 | 28.42 | 82.62 | 83.10334 |
| Title 21b | 93.64 | 28.42 | 81.94 | 82.06072 |
| Title 22b | 93.64 | 28.42 | 82.88 | 83.50199 |
| Title 23b | 93.64 | 28.42 | 83.37 | 84.2533 |
| Title 24b | 93.64 | 28.42 | 83.02 | 83.71665 |
| Title 25b | 93.64 | 28.42 | 83.02 | 83.71665 |
| Title 26b | 93.64 | 28.42 | 83.16 | 83.93131 |
| Title 27b | 93.64 | 28.42 | 81.56 | 81.47807 |
| Title 28b | 93.64 | 28.42 | 83.78 | 84.88194 |
| Title 29b | 93.64 | 28.42 | 83.07 | 83.79331 |

These results were then statistically evaluated according to the Two Sample T-Test at a 95% confidence interval, which confirmed that at this high confidence lever than the formulation of Ex. 4 according to the invention provided superior cleaning results as compared to the comparative composition.

I claim:

1. An aqueous hard surface cleaning composition comprising:

0.01–0.85% wt. of a nonionic surfactant compound based on an amine oxide;

0–1.5% wt. of a chelating agent;

0.01%–2.5% wt. of a caustic;

3.0–9.0% wt. of a glycol ether solvent system comprising a first glycol ether or glycol ether acetate solvent having a solubility in water of not more than 20% wt., and a second glycol ether or glycol ether acetate having a solubility of about 100% wt. in water, wherein the ratio of the first solvent to the second solvent is from 0.5:1 to 1.5:1;

0–5% wt. water-soluble, amine-containing organic compound;

soil anti-redeposition agent present at less than 2.5% wt.; and water to 100% wt.

2. The aqueous hard surface cleaning composition according to claim 1 wherein the nonionic surfactant compound is an alkyl di(lower alkyl) amine oxide compound containing 10–20 carbon atoms in its first alkyl group.

3. The aqueous hard surface cleaning composition according to claim 1 wherein the nonionic surfactant compound is an alkyl di(hydroxy lower alkyl) amine oxide which has about 10–20 carbon atoms in its alkyl group.

4. The aqueous hard surface cleaning composition according to claim 1 wherein the nonionic surfactant compound is an alkylmorpholine oxide containing 10–20 carbon atoms in its alkyl group.

5. The aqueous hard surface cleaning composition according to claim 1 wherein the chelating agent is selected from gluconic acid, tartartic acid, citric acid, oxalic acid, lactic acid, ethylenediaminetetraacetic acid, n-hydroxy ethylene diamine triacetic acid, nitrilotriacetic acid, diethylene triamine pentaacetic acid, and water soluble salts thereof.

6. The aqueous hard surface cleaning composition according to claim 5 wherein the chelating agent is a di-, tri- or tetra-sodium salt of ethylenediaminetetraacetic acid.

7. The aqueous hard surface cleaning composition according to claim 1 wherein the water-soluble, amine-containing organic compound is an alkanolamine containing no more than 20 carbon atoms.

8. The aqueous hard surface cleaning composition according to claim 7 wherein the alkanolamine contains no more than 6 carbon atoms.

9. The aqueous hard surface cleaning composition according to claim 8 wherein the alkanolamine is monoethanolamine.

10. The aqueous hard surface cleaning composition according to claim 1 wherein the water-soluble, amine-containing organic compound further contains one or more ethoxy, propoxy or butoxy groups.

11. The aqueous hard surface cleaning composition according to claim 10 wherein the water-soluble, amine-containing organic compound contains no more than 24 carbon atoms.

12. The aqueous hard surface cleaning composition according to claim 11 wherein the water-soluble, amine-containing organic compound contains no more than 12 carbon atoms.

13. The aqueous hard surface cleaning composition according to claim 1 wherein the glycol ether solvent system comprises a first glycol ether having a solubility in water of not more than 20% wt., and a second glycol ether having a solubility of about 100% wt.

14. The aqueous hard surface cleaning composition according to claim 1 wherein the composition has a pH of 12.5 or higher.

15. An aqueous hard surface cleaning composition comprising:

0.5–0.8% wt. of an amine oxide-based nonionic surfactant compound;

0.2–0.6% wt. of a salt of ethylenediamine tetraacetic acid;

0.1%–0.5% wt. of an alkali metal hydroxide;

1.5–4.0% wt. of an alkanolamine;

5.0–7.0% wt. of a glycol ether solvent system comprising a first glycol ether or glycol ether acetate solvent having a solubility in water of not more than 20% wt., and a second glycol ether or glycol ether acetate having a solubility of about 100% wt. in water, wherein the ratio of the first solvent to the second solvent is from 0.5:1 to 1.5:1;

soil anti-redeposition agent present at less than 0.7% wt.;

0–1.0% wt. of one or more constituents selected from the group consisting of preservatives, buffers, pH buffering agents, fragrances, fragrance carriers and adjuvants which increase their miscibility in the aqueous compositions, colorants, hydrotropes, antifoaming agents, anti-oxidants, anti-corrosion agents, and thickening agents; and water to 100% wt.

16. An aqueous hard surface cleaning composition comprising:

0.5–0.8% wt. of an amine oxide-based nonionic surfactant compound;

0.1–1.5% wt. of a chelating agent, selected from the group consisting of citrate, gluconate, and glucoheptonate salts;

0.1%–0.5% wt. of an alkali metal hydroxide;

1.5–4.0% of an alkanolamine;

5.0–7.0% wt. of a glycol ether solvent system comprising a first glycol ether or glycol ether acetate solvent having a solubility in water of not more than 20% wt., and a second glycol ether or glycol ether acetate having a solubility of about 100% wt. in water, wherein the ratio of the first solvent to the second solvent is from 0.5:1 to 1.5:1;

soil anti-redeposition agent present at less than 0.7% wt.;

0–1.0% wt. of one or more constituents selected from the group consisting of preservatives, buffers, pH buffering agents, fragrances, fragrance carriers and adjuvants which increase their miscibility in the aqueous compositions, colorants, hydrotropes, antifoaming agents, anti-oxidants, anti-corrosion agents, and thickening agents; and water to 100% wt.

17. A method for cleaning a hard surface having baked-on greasy or oily stains which comprises the step of: applying an effective amount of a composition according to claim 1.

18. The aqueous hard surface cleaning composition according to claim 1, wherein the caustic is selected from one or more of: calcined alkali metal carbonates, anhydrous alkali metal carbonates, calcined alkali metal hydroxides, anhydrous alkali metal hydroxides, phosphates, bicarbonates, silicates, and borates.

19. The aqueous hard surface cleaning composition according to claim 1, wherein the soil anti-redeposition agent is selected from the group consisting of compositions based on polyacrylic acids and salts thereof, fatty amide complexes, silicone copolymers, polyvinylpyrrolidone, synthetic hectorite, colloidal silica, styrene maleic anhydride copolymers, as well as esters and partial esters thereof, and polycarboxylate copolymers.

20. The aqueous hard surface cleaning composition according to claim 19, wherein the soil anti-redeposition agent is a polyacrylic acid-based compound.

* * * * *